US006098828A

United States Patent [19]

Shingleton

[11] Patent Number: 6,098,828

[45] Date of Patent: Aug. 8, 2000

[54] METHOD TO SOLICIT FUNDS

[76] Inventor: Patrick S. Shingleton, 6906 Monteau Ct., Baton Rouge, La. 70809

[21] Appl. No.: 09/317,516

[22] Filed: May 24, 1999

[51] Int. Cl.[7] ..... B65D 21/024

[52] U.S. Cl. ..... 220/23.4; 206/459.5

[58] Field of Search ..... 232/1 D, 4 R; 220/23.8, 23.83, 23.86, 23.4, 908, 909; 206/504, 459.5

[56] References Cited

U.S. PATENT DOCUMENTS

| | | | |
|---|---|---|---|
| 4,997,102 | 3/1991 | Bolling | 220/325 |
| 5,295,593 | 3/1994 | Sturm . | |
| 5,402,904 | 4/1995 | Close | 220/254 |

*Primary Examiner*—Stephen Castellano
*Attorney, Agent, or Firm*—Roy Kiesel & Tucker; William David Kiesel; Lance A. Foster

[57] ABSTRACT

A method of solicitation of funds to be used by an organization for the purchase of medicine, food or similar goods comprising the steps of: placing in a public location at least two physically bonded canisters, the first canister being larger than the second canister, the first canister having a top end forming an opening sized to permit a container of predetermined size to pass through the opening and into the first canister, the second canister constructed having an open top and forming a cavity of sufficient size into which more than one of the containers may be positioned for removal from the second canister, placing more than one of the containers in the second canister, the containers having removable lids that permit placing monies in the containers, and providing instructions to (i) remove the lid of one of the containers, then (ii) place monies in the container, then (iii) reseal the container with the lid, and (iv) drop the container through the opening and into the first canister.

13 Claims, 1 Drawing Sheet

METHOD TO SOLICIT FUNDS

BACKGROUND OF THE INVENTION

1. Field of the Invention

This invention relates in general to methods of soliciting funds, and more particularly, to methods for soliciting funds to be used to purchase medicine.

2. Prior Art

Methods for soliciting funds to be used for a multitude of varying charitable endeavors have been employed. Many of these methods involve the use of canisters into which persons may deposit money that is later collected. It is common practice to place the canister near the check out cash register of a store. One benefit of this location is that most store patrons will see the canister. A second benefit is that this is a location that will frequently be observed, and therefore, more likely to deter theft of the monies placed in the canister. However, one prior art problem is the limited amount of space available at this location in which to place the canister. Another problem is the need to design a canister that deters theft when the canister is not being observed. A third problem is the need to design a canister that stands out from its surroundings and will be noticed. Another problem is the need for the canister to quickly make evident the purpose of the solicitation . Although the prior art methods of solicitation utilizing a canister have proved effective, there remains a need for improved methods of solicitation of funds through the use of unattended canisters. These problems are particularly acute when monies are being solicited to purchase medicine for those unable to pay for their own medicine.

OBJECTS AND SUMMARY OF THE INVENTION

Therefore, one object of this invention is to provide a method for solicitation of funds utilizing an unattended canister placed in a public location which optimizes the available space, deters theft of the collected monies, is noticed and indicates the purpose of the solicitation.

Another object of this invention is to provide a method for solicitation of funds to be used by organizations to purchase of goods, such as medicine, food or other similar goods.

Still another object of this invention is to provide a method for solicitation of funds which utilizes a specialized canister particularly adaptable for the collection of monies to be used for the purchase of goods, such as medicine, food or other similar goods.

Accordingly, a method of solicitation of funds to be used by an organization for the purchase of goods is provided comprising the steps of: (a) placing in a public location at least two attached canisters, the first canister having a top end forming an opening of sufficient size to permit a smaller container shaped to simulate the goods to pass through the opening and into the first canister, the second canister constructed having an open top and forming a cavity sized to hold one or more of the smaller containers, (b) placing multiple empty containers in the second canister, the bottles having removable caps, (c) removing the cap of one of the bottles, (d) placing money in the bottle, (e) replacing the cap on the bottle, and (f) dropping the bottle through the opening and into the first canister.

BRIEF DESCRIPTION OF THE DRAWINGS

The accompanying drawings illustrate a preferred embodiment of this invention as it relates to the solicitation of monies for the purpose of purchasing medicine for needy persons. However, it is to be understood that this embodiment is not intended to be exhaustive, nor limiting of the invention. It is but one example of the form in which the invention may be practiced and is given for the purpose of illustration in order that others skilled in the art may fully understand the invention and the principles thereof and the manner of applying it in practical use so that they may modify and adapt it in various forms, each as may be best suited to the conditions of a particular use.

PREFERRED EMBODIMENTS OF THE INVENTION

Figure 1:
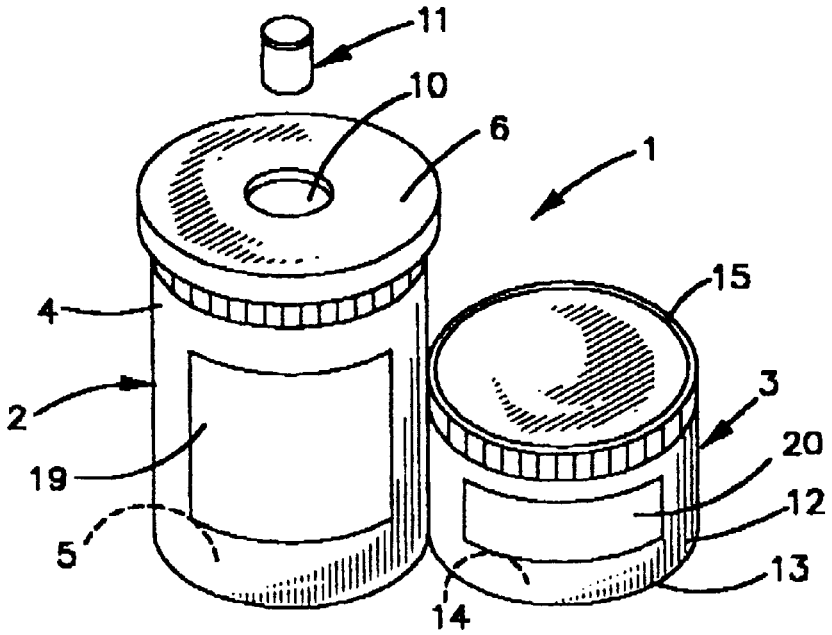
FIG. 1 is perspective view of a preferred embodiment of the dual canister device used in the method of the invention specifically adopted for the solicitation of monies used to purchase medicine for needy persons.
Figure 2:
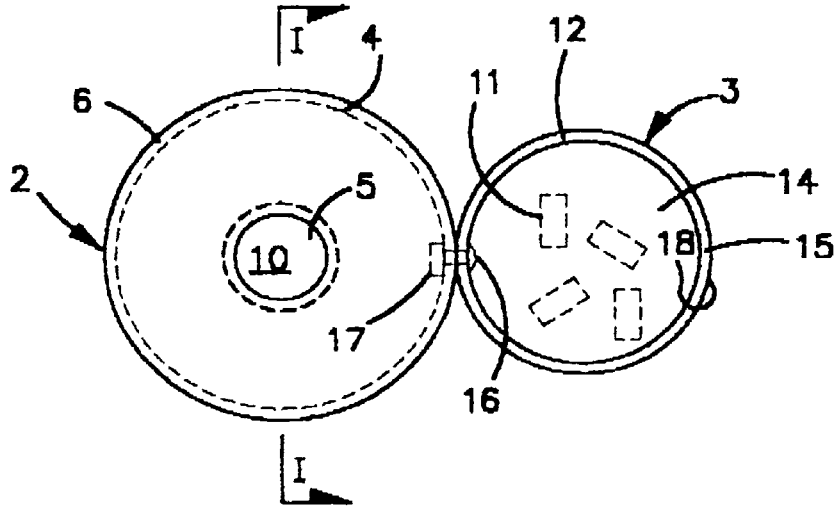
FIG. 2 is a top view of FIG. 1.
Figure 3:
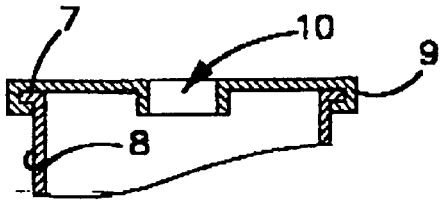
FIG. 3 is a cross sectional view taken along lines 1—1 of FIG. 2.

Without any intent to limit the scope of this invention, reference is made to the figures in describing the preferred embodiments of the invention. In the solicitation of funds for the purpose of a non-profit organization purchasing prescription medicines for needy persons, a canister construction 1, such as illustrated in FIG. 1 is preferably utilized. Both canisters 2 and 3 are shaped in the general design of a typical prescription bottle used to hold capsules, but sized to hold multiple bottles. Canister 2 is constructed of a hollow tube 4 having one end sealed by plate 5 and its other end covered by lid 6. Lid 6 is constructed so as not to be easily removable from tube 4. In one preferred embodiment illustrated in FIG. 3, tube 4 is provided with a lip 7 extending perpendicularly from tube wall surface 8. Lid 6 is provided with a mating retaining edge member 9 that fits about lip 7. In this embodiment lid 6 is constructed from plastic having sufficient flexibility to permit retaining edge member 9 to be fitted about lip 7. By increasing the thickness of the plastic or by selection of its composition the degree of flexibility can be modified to the extent desired to deter removal of lid 6 by unauthorized persons.

Lid 6 is also provided with an opening 10. In a preferred embodiment opening 10 is sized to permit a typical prescription bottle 11 to pass through opening 10 and into the canister 2. However, opening 10 is not large enough to permit a human hand to reach through.

The second canister 3 is also formed by a tube 12 having one end 13 sealed by plate 14. The opposite end 15 of tube 12 is open. Canister 3 is sized to hold multiple bottles 11 and to permit a person to easily reach into canister 3 to remove one of the bottles 11. In a preferred embodiment canister 3 will be shorter than canister 2 to permit a person to better distinguish between the two canisters and allow a clearer view of the empty bottles 11 placed in canister 3.

In a preferred embodiment, canisters 2 and 3 will be attached to one another. This attachment can be made in any conventional manner; e.g., by bolts 16, by gluing, by molding both as one piece, by fixing both to a common member such as a plate both canisters sit on, etc. If bolts are used, it is preferred in order to deter theft that the nut 17 be positioned inside canister 2 where it can not be easily reached by a person. This connected canister structure is bulkier and heavier than a single canister and therefore acts as a deterrent against theft. In this embodiment, it is preferred that the connected structure be rigid and of sufficient weight to further deter theft. A particularly preferred construction is to construct both canisters from a ≧¼" PVC tubing with canister 2 having a ≧8" diameter and canister 3 a ≧5" diameter.

It is preferred that the outside surfaces 8 and 18 of canisters 2 and 3, respectively, have imprinted or otherwise illustrated thereon images of medicine capsules or tablets to assist a person in understanding the purpose of the solicitation. It is also preferred that one canister surface contain a label 19 stating the purpose of the solicitation and the other canister surface contain a label 20 providing instruction on how to make the donation. It is also preferred that symbols representative of a pharmacy (e.g., mortar and pestle) and of medicine (e.g., "Rx" logo) be imprinted adjacent to either or both of the purpose statement and the instruction statement.

In use, the connected canisters 2 and 3 are placed near the check out register of a pharmacy or other retail store. A person then picks up one of the empty bottles from canister 3, removes its cap, places the donation into the bottle 11, recaps the bottle 11 and then places the bottle 11 into canister 3 by dropping through opening 10. On a periodic basis the canisters 2 and 3 are picked up by the collecting organization and the donations removed. The canisters are then repositioned near the check out register with the now empty bottles placed back in canister 3.

There are, of course, other alternate embodiments which are obvious from the foregoing descriptions of the invention which are intended to be included within the scope of the invention as defined by the following claims.

What I claim is:

1. A method of solicitation of funds to be used by an organization for the purchase of goods comprising the steps of:

(a) placing in a public location at least two physically bonded canisters, the first canister being larger than the second canister, said first canister having a top end forming an opening sized to permit a bottle of predetermined size to pass through said opening and into said first canister, said second canister constructed having an open top and forming a cavity of sufficient size into which more than one of said bottles may be positioned for removal from said second canister, (b) placing more than one of said bottles in said second canister, said bottles having removable caps that permit placing monies in said bottles, and (c) providing instructions to (i) remove said cap of one of said bottles, then (ii) place monies in said bottle, then (iii) reseal said bottle with said cap, and (iv) drop said bottle through said opening and into said first canister.

2. A method according to claim 1 wherein said first canister is shaped to resemble a container conventionally utilized to hold said goods.

3. A method according to claim 2 wherein said first canister is shaped to resemble a prescription bottle having a removable cap.

4. A method according to claim 3 wherein said second canister is shaped to resemble a prescription bottle with its cap removed.

5. A method according to claim 3 wherein the outside surface of said first canister is designed to appear to contain medicine.

6. A method according to claim 5 wherein the outside surface of said second canister is designed to appear to contain medicine.

7. A method according to claim 2 wherein said first canister is shaped to resemble a tin can of food.

8. A method according to claim 7 wherein said second canister is shaped to resemble a tin can of food with its top removed.

9. A method according to claim 1 wherein said instructions are affixed to the outside surface of said first canister or said second canister.

10. A canister assembly for solicitation of monies comprising:

a. a first hollow canister provided with a removable top lid having an opening;

b. a second hollow canister affixed to said first canister having an open top end; and c. one or more containers having a removable and resealable lid, said containers being sized to fit into said second canister and to pass through said opening.

11. A canister assembly according to claim 10 further comprising written instructions fixed to said first canister, describing the steps to be utilized to place the solicited monies into one of said containers located in said second canister and through said opening into said first canister.

12. A canister assembly according to claim 10 further comprising written instructions fixed to said second canister, describing the steps to be utilized to place the solicited monies into one of said containers located in said second canister and through said opening into said first canister.

13. A canister assembly according to claim 10 further comprising written instructions fixed to said first canister and said second canister, describing the steps to be utilized to place the solicited monies into one of said containers located in said second canister and through said opening into said first canister.

* * * * *